United States Patent [19]

Kasahara

[11] 4,124,831

[45] Nov. 7, 1978

[54] CIRCUIT BREAKER

[75] Inventor: Yasuo Kasahara, Tokyo, Japan

[73] Assignee: Tokyo Kinzoku Co. Ltd., Japan

[21] Appl. No.: 781,049

[22] Filed: Mar. 24, 1977

[30] Foreign Application Priority Data

Mar. 26, 1976 [JP] Japan ..... 51-33267

[51] Int. Cl.[2] ..... H01H 61/02; H01H 61/04

[52] U.S. Cl. ..... 335/16; 335/17; 335/170

[58] Field of Search ..... 335/1, 16, 17, 166, 335/170

[56] References Cited

U.S. PATENT DOCUMENTS

| | | | |
|---|---|---|---|
| 3,453,566 | 7/1969 | Kasahara | 335/16 |
| 3,469,217 | 9/1969 | Linton | 335/17 X |
| 3,605,047 | 9/1971 | Kasahara | 335/170 X |
| 3,702,980 | 11/1972 | Kasahara | 335/170 X |
| 3,743,982 | 7/1973 | Kasahara | 335/16 X |

*Primary Examiner*—A. D. Pellinen

*Attorney, Agent, or Firm*—Stevens, Davis, Miller & Mosher

[57] ABSTRACT

A circuit breaker using magnetic latching force between a magnet element and an attracting magnet member and having a bias spring which normally applies a bias force to the magnet element establishing the magnetic latching force in the closing condition in a direction to separate the magnet element from the magnet member and it also acts to apply a contact pressure to a circuit breaker contact in the same closing condition.

5 Claims, 7 Drawing Figures

1
2
3
4
5
6
6'
7
8
9
10
11
12
13
14
15
16
17
18
19
20
21
22
23'
24
25
26
27
28
29
30
31
32
33
35
36
37
38
39
40
47
48
53
54
55
56
57
58
59
60
61
62
A
B
C
D
E
F
M
R1
R2

CIRCUIT BREAKER

BACKGROUND OF THE INVENTION

1. Field of the Invention

The present invention relates to a circuit breaker or a circuit protector provided on a power board and more especially relates to a magnetic latch type, no fuse circuit breaker or circuit protector.

2. Description of the Prior Art

Circuit breakers of this kind are generally requested to open an electric circuit quickly and definitely at a time of occurrence of short circuit in order not to damage the circuit breaker itself and also for the devices connected to the circuit through said circuit breaker. There are various suggestions for such a circuit breaker to open the circuit quickly in case of occurrence of circuit trouble. For instance, there have been suggestions using temperature operation of a magnetic latch type device in order to obtain time lag circuit breaking operation based on a thermal demagnetization function and/or an instantaneous circuit breaking operation using an electromagnetic operative function.

The conventional circuit breakers are generally complicated in construction. Contactors of such conventional circuit breakers are either of the self closing type using spring force making its own contact or of the forced contact type using spring force specially provided therefor. The former has a disadvantage in that the spring force of the contactor may make the opening time of breaker longer and the latter also has a disadvantage in that the additional spring to apply bias force to increase the contact force may make the opening time of the breaker longer so that the contact pressure can not be made sufficiently high in both cases. Accordingly, the conventional circuit breakers had generally high contact resistance and there was a fear of damaging the contactor at its current flowing portion by an arc occurring at the time of opening the breaker.

The present invention has for its object to mitigate the aforementioned disadvantages of the conventional devices and to obtain a circuit breaker having a bias spring acting against magnetic latching force which can also act to apply contacting pressure at the time of closing the circuit breaker.

The circuit breaker of the present invention is characterized in that it comprises in combination, a pair of lead terminals, an attracting magnet member having a conductive soft magnetic element of which one end is connected to one of said lead terminals, a stationary contact secured to the other end of said attracting magnet member, a magnet element arranged oppositely against said attracting magnet member, a magnetic latching member holding said magnet element and arranged in a movable manner integrally with the magnet element against said attracting magnetic member, a moving spring assembly pivoted to said magnetic latching member, a moving contact secured at one side of the moving spring assembly with respect to a pivoting shaft and in a position oppositely facing against the stationary contact, which moving contact forms a circuit breaker contact together with said stationary contact, and a bias spring engaged with said moving spring assembly at the other side with respect to the pivoting shaft and acting to apply a bias force to the magnetic latching member together with the magnet element held therein in a direction away from the attracting magnetic member, wherein under the closing condition of the circuit breaker in which the magnet element is attracted to the attracting megnetic member and the moving contact is under contact with the stationary contact, the bias spring applies a pressure to the moving contact toward the stationary contact.

DESCRIPTION OF PREFERRED EMBODIMENT

The invention will now be described by referring to the accompanying drawings.

Figure 1:
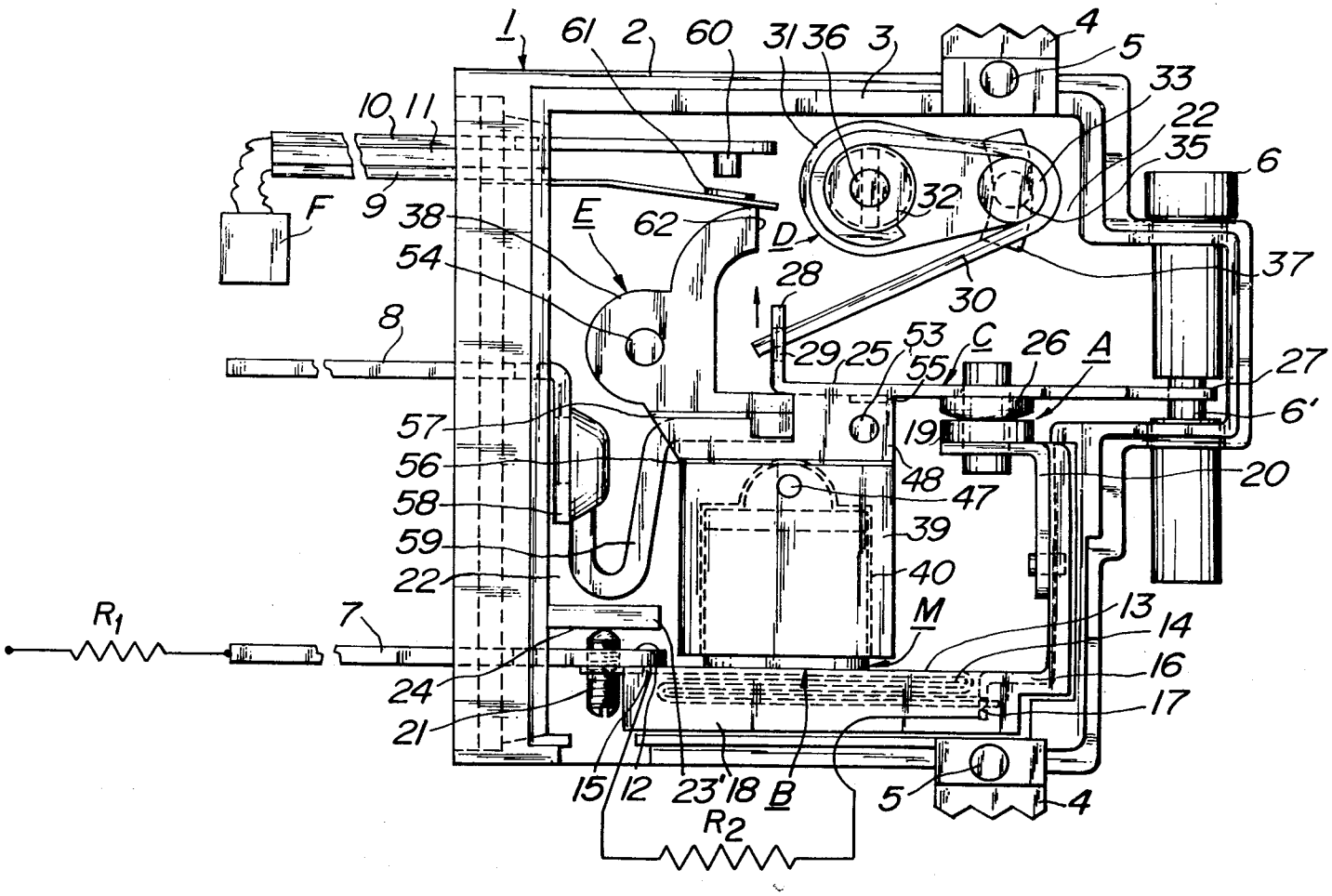
FIG. 1 is a front elevation showing the general configuration of one embodiment a circuit breaker of the present invention.
Figure 2:
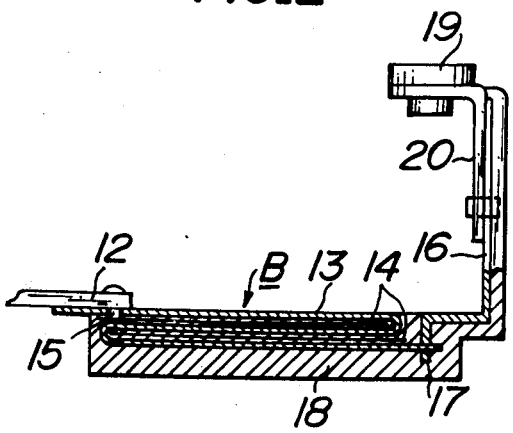
FIG. 2 is a front elevation showing the magnetic contact portion of the circuit breaker of the present invention.

FIG. 1 is a front elevation of one embodiment of the circuit breaker of the present invention, in which 1 generally shows the circuit breaker. 2 is a mold casing, 3 a step portion for joining the periphery of the lid, 4 a holder for mounting the circuit breaker 1 in a socket of a power distribution board (not shown), 5 a hole mating with a projection provided with the lid, 6 an indicating and switching lever for manually switching the circuit breaker contact A and for indicating the ON-OFF condition of the same, 7 and 8 lead connecting terminals, 9 and 10 connecting terminals for alarm or display device F for sending an alarm such as a buzzer or the like of the open condition of the circuit breaker contact A, and 11 is an insulating member for insulating the terminals 9 and 10.

At free end 12 of the lead connecting terminal 7 extending inside the casing 2, a conductive soft magnetic element 13 of an attracting magnet member B, bent several times with interposition of an insulating material 14 such as mica sheet, is secured. This portion B is a magnet member to attract a magnetic element M which will be described hereinafter. This attracting magnet member B is welded to the free end 12 of the lead connecting terminal 7 at hole 15 provided at one end of said conductive magnetic element 13. The other end of the element 13 is passed through a hole 17 provided at one end of a stationary connecting conductor 16 and the element 13 is electrically connected to the conductor 16 by means of soldering or the like. The element 13 and the conductor 16 are embedded integrally by a plastic mold 18. The fixed conductor 16 is connected with a conductor 20 having a stationary contact 19 by means soldering or the like.

As can be seen from FIG. 1, at the free end 12 of the lead connecting terminal 7, a position adjusting screw 21 is provided. Top of the screw 21 is engaged with a stopper formed by a mold wall 24 of a molded projection 23' provided integrally with a back plate 22 of the casing 2. By this screw 21, the attracting magnet member B is brought in contact with an opposite surface of the magnet element M.

Figure 3:
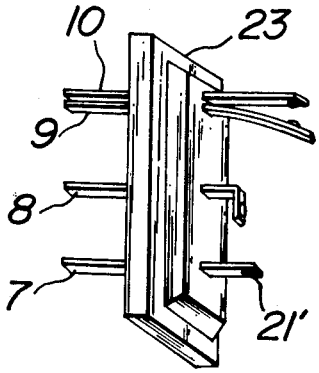
FIG. 3 is a perspective view showing an example of lead connecting terminals.

The above mentioned terminal 7 is secured to the attracting magnet member B and terminals 8, 9 and 10 are molded integrally on a mold base 23 as can be seen from FIG. 3. In this figure, reference numeral 21' shows a threaded hole of the position adjusting screw 21.

Figure 4:
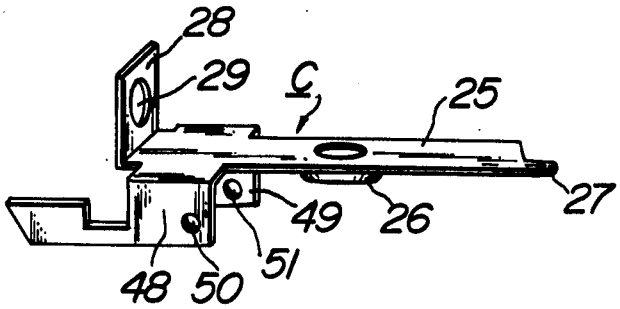
FIGS. 4, 5, 6 and 7 are perspective views showing the moving contact mounting portion, spring base, magnetic latching member and a magnet element, respectively.

FIG. 4 shows a moving leaf spring 25 of a moving contact assembly C. This spring 25 has a moving contact 26. The spring 25 is so arranged that the contact 26 can come in contact with the stationary contact 19. The moving contact 26 and the stationary contact 19 form the circuit breaker contact A. A free end 27 of the moving spring 25 of the moving contact assembly C is coupled with a narrower portion 6' provided at the middle of the indicator and switching lever 6 as shown in FIG. 1. By this arrangement, when the swtiching lever 6 is moved upward the circuit breaker contact A can be opened. Also if the contact A opens, the lever 6 can be brought upward. A vertical portion 28 is provided for the moving spring 25 at the opposite end to the free end 27 and a hole 29 is provided in this portion 28. Through this hole 29, an end of a spring 30 mounted on a spring mounting member D, which will be explained hereinafter, is engaged and the spring 30 applies a bias force for the moving spring 25 in the direction of the arrow shown in FIG. 1. The direction of the bias force caused by the spring 30 is opposite to the magnetic latching force between the attracting magnet member B and the magnet M as will be fully explained hereinafter.

Figure 5:
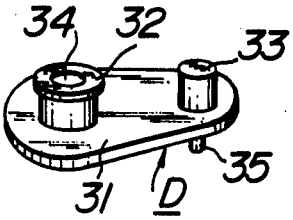

FIG. 5 shows a perspective view of the spring mounting member D. This member D has a base spring mount plate 31 having two cylindrical projections 32 and 33 formed integrally therewith . The projection 32 has threaded hole 34 in the center. The plate 31 has a projecting nob 35 at the opposite side of the projection 33. The spring mounting member D is secured on the back plate 22 of the casing by a screw 36 engaged with the threaded hole 34 of the projection 32 and also by the nob 35 engaged with a guide groove 37 provided in the back plate 22 of the casing. The spring 30 is mounted about the round peripheries of the projections 32 and 33. The bias force applied by the spring 30 to the aforementioned moving spring 25 can be adjusted by moving the base spring mount plate 31 by means of the screw 36 which fastens the projection 32 against the back plate 22 of the casing.

Figure 6:
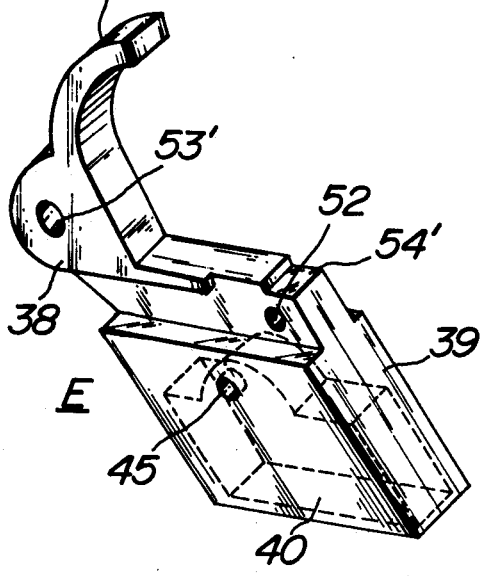

FIG. 6 shows a perspective view of the magnetic latching member E for performing the magnetic latching action together with the magnet member B. The magnetic latching member E has a cavity 40 shown by a dotted line in FIG. 6 open side down in the box like shaped portion 39. In the cavity 40, a magnet element M is mounted as will be explained hereinafter.

Figure 7:
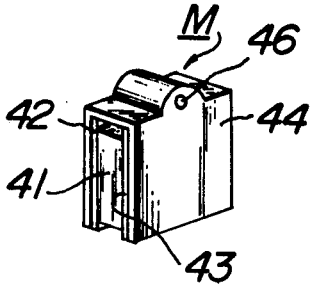

The magnet M is shown in FIG. 7 in the perspective view. As shown in this figure, pole pieces 42 and 43 are joined at both surfaces of a permanent magnet 41. The permanent magnet 41 together with the pole pieces 42 and 43 is encapsulated in a channel type mold case 44 which may mate with the cavity 40 of the magnetic latching member E (FIG. 6).

The magnet element M is housed in the cavity 40 formed in the box like shaped portion 39 of the magnetic latching member E. The magnet element M is pivoted by a pin 47 passing through a hole 46 provided in the mold case 44 and a hole 45 provided in the box shaped portion 39 of the latching member E in a manner such that the magnet element M can swing in the cavity 40. The magnetic latching member E is further mounted with the moving contact assembly C shown in FIG. 4. This mounting of the moving contact assembly C is effected by a pin 53 (FIG. 1) passing through holes 50 and 51 provided at bent portions 48 and 49 of the spring 25 forming the assembly C and a hole 52 provided in the body 38 of the magnetic latching member E in a swingable manner. In the embodiment shown in the drawing, the position of the holes 50 and 51 formed in the moving spring 25 is selected nearly at middle point between the upward bent portion 28 and the mounting point of the moving contact 26. The magnetic latching member E has a hole 53' in the body 38 and the member E is mounted on the case on its back plate 22 by a pin 54 extending therefrom and passing through the hole 53' so that the moving contact assembly C and the magnet element M can rotate freely. In order to give effective bent for the moving spring 25 of the moving contact assembly C when the assembly C is mounted on the magnetic latching member E, a stepwise shoulder portion 54; is provided in the body 38 above the hole 52 and the size of the bent portions 48 and 49 of the moving spring 25 is suitably arranged so as to form certain plays 55, 56 and 57 as shown in FIG. 1.

Free end 58 of the lead terminal 8 extending inside the casing 2 is electrically connected to the moving contact 26 of the moving contact assembly C by a flexible conductor 59. This connection can alternatively be made at the moving spring 25 when this spring is made of conducting material.

The conductive magnetic element 13 forming the attracting magnet member B is made of magnetic alloy having reversible temperature dependence of permeability. The permanent magnet 41 forming the magnet element M is preferably made of for example Alnico V magnet, Barium ferrite or the like having thermo reversible dependence characteristics for spontaneous magnetization. However, if the conductive magnetic element 13 is made of a substance having reversible temperature dependence of permeability, or if a time lag breaker operation for an overcurrent is not requested, the magnet element M can be formed from an ordinary permanent magnet or electro magnet without having the aforementioned characteristics.

In the embodiment shown in the drawing, a separately provided alarm or indicator device F connected to the terminals 9 and 10 may be energized when the circuit breaker contact A is opened. For this purpose, a stationary alarm contact 60 is secured at a free end of the terminal 10 extending inside the casing 2 and a moving alarm contact 61 is secured at a free end of the terminal 9 and the free end mounting the contact 61 is nomally arranged to rest on a top end portion of a lever 62 formed in the body 38 of the magnetic latching member E.

The circuit breaker 1 having the abovementioned construction is used in a utilizing circuit including a current source by connecting the circuit between the connecting lead terminals 7 and 8. The load current will flow through the following circuit. Outer lead terminal 7 - conductive magnetic element 13 - stationary conductor 16 - conductor 20 - stationary contact 19 - moving contact 26 - (moving spring 25) - flexible conductor 59 - outer lead terminal 8.

The operation of the circuit breaker according to the present invention will now be described hereinafter.

The condition shown in FIG. 1 is that the outer utility device (not shown) connected between the lead connecting terminals 7 and 8 carries a nominal current. Under such condition i.e., when a nominal current is flowing through the circuit, the magnet element M adjacently arranged with the attracting magnet member B is effectively attracted toward the member B by the magnetic latching force predominant between the permanent magnet 41 in the magnet element M and the conductive magnetic element 13. This magnetic latching force overcomes the mechanical bias force of the spring 30. In this condition the moving spring 25 of the moving contact assembly C is applied with a bias force by the spring 30 at the vertical portion 28 toward a direction to release the magnetic latching. Whereas the moving spring 25 mounted on the magnetic latching member E is so arranged as to provide plays at 55, 56 and 57 and it provides stress toward attracting magnet member B by a slight bent thereof. Accordingly, the circuit breaker contact A can maintain the closing condition under a contact spring pressure substantially same as that of the bias spring 30. In other words, the bias force of the spring 30 should be designed to have its upper limit to effectively maintain the attracting condition of the magnet element M toward the attracting magnet member B under a nominal current flowing therethrough.

If the current path is to be interrupted manually when a nominal current is passing through the circuit breaker 1, the display and switching lever 6 may be operated against the magnetic latching force of the magnet element M. In this case, the magnet element M is forced to separate from the attracting magnet member B and rotate about pivoting pin 54 of the magnetic latching member E. The moving alarm contact 61 is pushed upward by the pushing lever end 62 of the body 38 of the latching member to close the contact against the stationary contact 60. The electric circuit for the outer device is thus disconnected and at the same time the display and alarm device F connected between the terminals 9 and 10 operates to indicate or to give alarm of the disconnection of the electric circuit.

A situation when an overcurrent exceeding the nominal current happens in the outer device by some external cause will be explained hereinafter.

Generally speaking, a circuit breaker may preferably have so called time lag release characteristics in which the circuit should not be opened immediately at a minor overcurrent for instance 120% overcurrent exceeding the nominal current, but it should be opened after a certain time delay when the overcurrent reaches 125%. In the embodiment of the present invention, the time lag operation of the magnetic latching member E for such kind of overcurrent is realized by using the conductive magnetic member 13 having inverse time characteristics in the thermal demagnetization characteristics and also an instantaneous release operation of the magnetic latching member E is effected against an extraordinary heavy current such as a short circuit current.

The time lag operation or the instantaneous operation of the magnetic latching member E due to overload current or an extraordinarily heavy current such as a short circuit current will now be explained.

The conductive magnetic member 13 is heated to raise its temperature by the overload current passing through the current path due to Joule's heat induced in it and that induced in resistors $R_1$ or $R_2$ connected in series or in parallel thereto. By the temperature raise, the magnetic latching force between the magnet element M and the attracting magnet member B decreases gradually and finally the bias force of the spring 30 overcomes the latching force after a certain time lag, and the magnetic latching member E is rotated about the pin 54 so that the magnet element M is separated from the attracting magnet member B. Accordingly, the circuit breaker contact A becomes instantly an open condition at the rotation of the magnetic latching member E by a contact opening force, which is substantially equal to the bias force of the spring 30.

In this contact breaking operation, the contact closing force or the contact pressure of the spring 25 can remain substantially constant until opening of the contact A due to the provision of the plays 55 and 57 and to the rotatable mount of the spring 25 by the pin 54 through the hole 53'. We may term this operation as the contact follower operation of the spring 25, which is one of the advantages of the present invention.

At the same time of the opening of the breaker contact A, the moving alarm contact 61 is energized by the rotation of the magnetic latching member E with its end 62 so as to close contact against the stationary contact 60. By this action the outside display and alarm device F is operated. The display and switching lever 6 is also brought upward by the free end 27 of the moving spring 25 at the opening of the circuit breaker contact A to indicate the "OFF" condition of the circuit.

If an extraordinarily heavy current such as a short circuit current is passed through the conductive magnetic member 13, the magnetic field component induced by the permanent magnet 41 against the attracting magnet member B is greatly deformed by the electromagnetic reaction of such a heavy current. The magnetic latching force acting between the magnet element M and the conductive magnetic member 13 decreases instantaneously and the magnetic latching member E is abruptly rotated by the bias force of the spring 30 and thus separated from the attracting magnetic member B. The outer alarm or display device F operates after the release of the circuit breaker contact A in the same manner as has been explained in the foregoing.

In the opening condition of the circuit breaker contact A, the display and switching lever 6 is pushed upward by the free end 27 of the movable spring 25 to indicate the OFF condition and this condition is effectively maintained by the spring 30 engaged at the vertical portion 28 of the spring 25. The magnetic attracting force of the permanent magnet 41 working to the attracting magnetic member B greatly decreases under this condition by the separated distance so that the magnet element M is not attracted to come to the attracting magnet member B.

For closing the circuit breaker contact A again, the display and switching lever 6 may be operated to make the magnet element M separate away from the attracting magnetic mamber B to come close to it and be attracted thereby and thus to close the circuit breaker contact A. It is apparent that any failure in the utilizing circuit should be repaired prior to the closing of the circuit. Otherwise possible overcurrent or short circuit current may flow through the circuit and the circuit breaker may operate again.

According to one favorable aspect of the present invention, the bias force of the spring 30 acting against the magnetic latching force in the closing condition can be utilized as the contact pressure of the circuit breaker contact and moreover the contact opening force at the time lag or instantaneous opening at an occurrence of overcurrent or short circuit current can be made sufficiently high, substantially the same as the bias force of the spring 30 so that the production of an arc at closing or opening of the circuit breaker can be suppressed effectively.

It should be noted that the present invention is not limited to the abovementioned embodiment only and various alterations or modifications are possible. For instance, in the aforementioned embodiment, the position of the through holes 50 and 51 shown in FIG. 4 for pivotally mounting the moving spring 25 to the body 38 of the magnetic latching member is made at the approximate center position of the moving contact 26 and the vertical portion 28 of the spring 25 so as to apply a contact pressure to the circuit breaker contact A at its closing time nearly equal to the bias force of the spring 30. However, the contact pressure caused by the spring 30 can be settled at will by suitably arranging the mounting position of the moving contact 26 of the moving spring 25, position of the vertical portion 28 and relative positions of the moving spring 25 and its pivot axis.

What is claimed is:

1. A circuit breaker comprising in combination, a pair of lead terminals, an attracting magnet member having a conductive magnetic element of which one end is connected to one of said lead terminals, a stationary contact secured to the other end of said attracting magnet member, a magnet element arranged oppositely against said attracting magnet member, a magnetic latching member holding said magnet element and arranged in a movable manner integrally with the magnet element against said attracting magnetic member, a moving spring assembly pivoted to said magnetic latching member, a moving contact secured at one side of the moving spring assembly with respect to a pivoting shaft and in a position oppositely facing against the stationary contact, which moving contact forms a circuit breaker contact together with said stationary contact, and a bias spring engaged with said moving spring assembly at the other side with respect to the pivoting shaft and acting to apply a bias force to the magnetic latching member together with the magnet element held therein in a direction away from the attracting magnetic member, wherein under the closing condition of the circuit breaker in which the magnet element is attracted to the attracting magnetic member and the moving contact is under contact with the stationary contact, the bias spring applies a pressure to the moving contact toward the stationary contact.

2. A circuit breaker as claimed in claim 1, wherein the moving spring assembly is mounted on said magnetic latching member with a certain play to allow it to rotate freely in a small angle enabling contact follower operation of the spring assembly at a time of opening of the circuit breaker contact.

3. A circuit breaker as claimed in claim 1, further comprising a display and switching lever engaged with said moving contact assembly at its free end located at a side of the moving contact, which display and switching lever can indicate the switching condition of the circuit breaker contact, wherein the closing condition of the circuit breaker contact can be released by the switching lever against the magnetic latching force of the magnet element and the opening condition of the circuit breaker contact can be switched to close the contact by the switching lever against the bias force of the bias spring.

4. A circuit breaker as claimed in claim 1, further comprising a moving alarm contact operated by said magnetic latching member and connected to an alarm device, and a stationary alarm contact arranged opposite to said moving alarm contact and also connected to the alarm device, wherein said pair of alarm contacts are closed to establish a circuit at an opening condition of the circuit breaker contact to operate the alarm device.

5. A circuit breaker as claimed in claim 1, further comprising at least a resistor element connected in series or in parallel with the conductive magnetic element so as to supplement Joule heat producing in the attracting magnet member.

* * * * *